United States Patent [19]

Kuroda et al.

[11] 4,432,694

[45] Feb. 21, 1984

[54] BLOWER

[75] Inventors: Sigeaki Kuroda; Akira Arai, both of Shimizu; Takao Senshu, Shizuoka; Shinjiro Ueda, Abiko; Masamichi Hanada; Mineo Takahashi, both of Shimizu, all of Japan

[73] Assignee: Hitachi, Ltd., Tokyo, Japan

[21] Appl. No.: 237,711

[22] Filed: Feb. 24, 1981

[30] Foreign Application Priority Data

Feb. 25, 1980 [JP] Japan ..... 55-21671

[51] Int. Cl.[3] ..... F04D 29/16

[52] U.S. Cl. ..... 415/170 A; 415/172 R; 415/DIG. 1; 416/186 R

[58] Field of Search ..... 415/119, 53 R, 170 A, 415/DIG. 1, 172 R, 170 B, 110; 416/186 R, 187; 123/41.11

[56] References Cited

U.S. PATENT DOCUMENTS

| | | | |
|---|---|---|---|
| 1,787,656 | 1/1931 | Anderson | 415/53 |
| 2,305,136 | 12/1942 | Campbell | 416/186 |
| 3,368,744 | 2/1968 | Jenn | 416/186 R |

FOREIGN PATENT DOCUMENTS

| | | | |
|---|---|---|---|
| 5566695 | 5/1980 | Japan | 416/186 R |
| 2037890 | 7/1980 | United Kingdom | 123/41.11 |

*Primary Examiner*—Philip R. Coe

*Attorney, Agent, or Firm*—Antonelli, Terry & Wands

[57] ABSTRACT

A centrifugal blower including a casing formed with a discharge port and a suction port, and an impeller mounted in the casing and having a plurality of backwardly curved vanes arranged circumferentially of the impeller. The suction port has a semicircular suction member located in spaced juxtaposed relation to a semicircular curled portion formed at the forward end of a shroud of the impeller. An annular guide plate may be attached to the inner side of the suction member and formed at its open end with a wall portion disposed along the shroud which is formed at its forward end with an annular wall extending into a space defined between the suction member and the guide plate. Hair may be provided on one of opposed wall surfaces of the suction member and the annular wall of the shroud.

3 Claims, 6 Drawing Figures

BLOWER

BACKGROUND OF THE INVENTION

This invention relates to a centrifugal blower of low static pressure.

A centrifugal blower comprises an impeller mounted in a casing for rotation to draw a fluid, for example, air, through a suction port of the casing axially into the blower and blow the fluid by the vanes centrifugally into the casing, so that the fluid is blown in a predetermined direction through a discharge port open at one side of the casing. The majority of the fluid, blown into the casing by traversing the vanes, is guided by the casing and blown in the predetermined direction through the discharge port. However, part of the fluid blown into the casing in this way flows through the casing and a clearance between a suction member of the casing and a shroud of the impeller to the suction side of the casing. Because the fluid once drawn into the casing leaks to the suction side, the performance of the blower is reduced and the power required to operate the impeller increases. The air leaking to the suction side produces noises.

In view of the aforesaid problems encountered in centrifugal blowers of the prior art, it has been earnestly desired to reduce the volume of air leaking to the suction side of the blower after being blown into the casing. The performance of a blower can be improved by reducing the size of the clearance between the suction member and the shroud. However, since the suction member is stationary and the shroud rotates, the minimum size of the clearance is determined by the precision with which the suction member and the shroud are fabricated and assembled. Thus, there is a limit to the improvement in the performance of the blower that can be achieved by reducing the size of the clearance.

Proposals have been made to provide means for preventing air from leaking into the clearance between the suction member and the shroud in addition to reducing its size. U.S. Pat. No. 3,782,851 discloses a centrifugal fan device wherein walls project in staggered relation into a clearance between the suction port and the shroud to thereby increase the length of the path through the clearance, so as to thereby increase the resistance offered by the path to the flow of air and hence to minimize the volume of air leak passing through the clearance.

U.S. Pat. No. 3,842,902 discloses an axial blower in which each blade has an annular seal member attached to its forward end, and the seal members and the shroud are formed in various shapes to avoid the flow or air leak by the forward ends of the blades.

SUMMARY OF THE INVENTION

An object of this invention is to provide a centrifugal blower of a shape suitable for reducing the volume of air flowing to the suction side of the blower after being blown into the casing, in order to improve the performance of the blower, reduce the power required for operating the blower and lower noises produced by the blower.

Another object is to provide a centrifugal blower of a shape suitable for increasing the precision with which parts of the blower are fabricated and assembled.

The outstanding characteristics of the invention are that the suction member of the casing of the centrifugal blower is shaped in semicircular form and that the shroud of the impeller is formed at its forward end on the suction side with a semicircular curled portion which is positioned against the semicircular suction member.

The air on the suction side of the blower flows axially into the impeller as the latter rotates to flow centrifugally into the casing while the flow takes place through the vanes. The majority of the air is blown into the casing and collected in an open end to be blown through the open end out of the blower. However, part of the air swirls in the casing and flows toward the curled portion of the shroud. The suction member and the forward end of the shroud define therebetween a semicircular clearance which offers resistance to the flow of air. Thus, only a small portion of the air directed in its flow toward the curled portion flows into the semicircular clearance defined between the suction member and the forward end of the shroud of the semicircular shape, thereby minimizing the volume of air leak flowing toward the suction side of the blower. The rest of the air flows in vertical flow along the curled portion of the shroud back into the casing in return flow, and the stream of air of this return flow acts as a countercurrent with respect to the stream of air tending to flow into the semicircular clearance, so that the air stream tending to flow into the semicircular clearance can be inhibited and the volume of air leak into the clearance can be further reduced. Thus, the performance of the blower can be improved. The air leak is drawn into the impeller again at the suction side. Since the clearance is in semicircular form, the air leak has its flow regulated when passing through the clearance into the impeller, so that the air drawn into the impeller is not disturbed and no noises are produced.

By providing a curled portion to the forward end of the shroud on the suction side, it is possible to minimize the clearance between the shroud and the suction member while increasing the precision with which the parts are fabricated. By virtue of this feature, fabrication of the parts is facilitated and the performance of the blower can be greatly improved because the part has increased strength and shows no deformation during operation.

In another aspect, the invention provides, in a centrifugal blower, the outstanding characteristics that an annular guide plate is attached to the inner side of the suction member and formed at its open end with a wall portion located along the shroud of the impeller, and that the shroud is formed at its forward end of the suction side with an annular wall portion extending into a space defined between the suction member and the guide plate.

In this type of blower, part of the air blown into the casing upon rotation of the impeller flows around the casing toward the guide plate, to pass through a clearance defined between the annular guide plate and the forward end of the shroud in the form of air leak which is drawn again to the suction side. Since the open end of the guide plate on the inner side of the suction member is formed with a wall portion located along the shroud, part of the air flows in vertical flow along the guide plate and is guided by the wall portion in return flow toward the casing, to constitute a countercurrent with respect to the stream of air leaks tending to flow into the clearance. Thus, the flow of air leak into the clearance is inhibited and the volume of air leak can be reduced, thereby improving the performance of the blower.

Experiments were conducted on a centrifugal blower in which the annular guide plate is shaped to have an obtuse angle and the wall portion parallel to the shroud is extended to the outer periphery of the impeller. The results obtained show that the stream of air leak tending to flow into the clearance between the suction member and the shroud is drawn by suction by the air blown in a centrifugal direction by the impeller upon its rotation, thereby further reducing the volume of air leak passing into the clearance and further improving the performance of the blower.

In still another aspect, the invention provides, in a centrifugal blower, the outstanding characteristics that the shroud of the impeller is formed at its forward end on the suction side with an annular wall positioned against the suction member, and that at least one of the surfaces of the wall of the suction member and the annular wall of the shroud has hair planted thereon. By virtue of the hair planted on one of the wall surfaces defining a clearance between the suction member and the shroud, the air leak passing through the clearance to the suction side flows through the hair, so that a resistance of high magnitude is offered by the hair to the air flowing through the clearance. Thus, the volume of air leak is minimized and the performance of the blower is improved.

DESCRIPTION OF THE PREFERRED EMBODIMENTS

Figure 1:
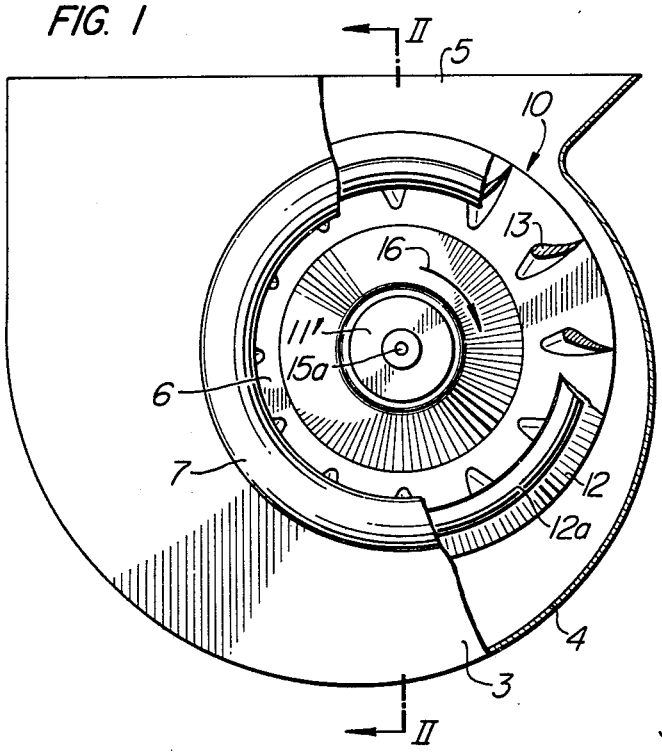
FIG. 1 is a front view of the centrifugal blower comprising one embodiment of the invention, with the casing and the impeller being partially broken away.
Figure 2:
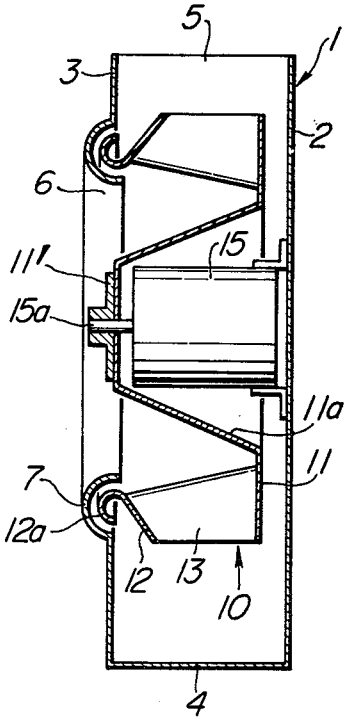
FIG. 2 is a sectional view taken along the line II—II in FIG. 1.

FIGS. 1 and 2 show a first embodiment of the invention in which a casing generally designated by the reference numeral 1 includes end plates 2 and 3 and a side plate 4 connecting the end plates 2 and 3 together. The casing 1 has a discharge port 5 formed at its outer periphery and a suction port 6 formed in the end plate 3 and having a semicircular suction member 7. Mounted in the casing 1 is an impeller generally designated by the reference numeral 10 having vanes 13 circumferentially arranged between a rotary plate 11 and a shroud 12. The rotary plate 11 includes a hub 11' located in the center, a conical portion **11*a* extending from the hub 11' toward the rear of the casing 1 and an annular plate portion located outside the conical portion 11*a*. The vanes 13, which are backwardly curved with respect to the direction of rotation of the impeller 10, are arranged between the annular plate portion of the rotary plate 11 and the shroud 12 which is inclined. The shroud 12 has a semicircular curled portion 12*a* at its forward end on the suction side which is juxtaposed against the suction member 7**.

An electric motor 15 is mounted in a space defined by the conical portion **11*a* of the rotary plate 11 of the impeller 10 and has a rotary shaft 16*a* having the hub 11' attached thereto. The numeral 16 designates the direction of rotation of the impeller 10**.

Figure 3:
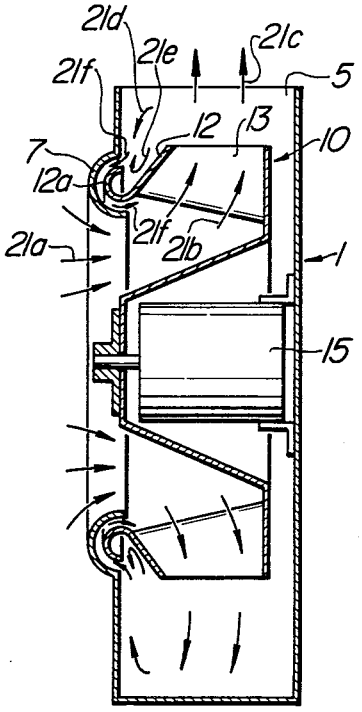
FIG. 3 is a sectional view similar to FIG. 2 but indicating streams of air.

As shown in FIG. 3, upon rotation of the impeller 10 in the direction of the arrow 16 as the motor 15 is actuated, fluid or air is induced to flow through the suction port 6 into the impeller 10 as indicated by arrows **21*a* and passes through the path of the rotating vane 13, to be blown in a centrifugal direction 21*b* into the casing 1. The majority of the air blown into the casing 1 is guided by the casing 1 and collected in the discharge port 5 from which the air is blown in the direction of arrows 21*c* out of the blower. However, part of the air blown into the casing 1 passes toward the front of the casing 1 as indicated by arrows 21*d* and tends to flow toward the curled portion 12*a* of the shroud 12 and the suction member 7. A portion of this air stream changes its direction of flow as indicated by an arrow 21*e* and returns to the casing 1, while another portion thereof passes through a narrow semicircular clearance defined between the curled portion 12*a* of the shroud 12 and the suction member 7 in the direction of an arrow 21*f*. Air leaking in this way has its flow regulated by the semicircular clearance which offers resistance to the flow of air before being drawn into the impeller 10 again, so that the air drawn into the impeller shows no disturbance and produces no noise. The portion of air returning to the casing 1 as indicated by the arrow 21*e* functions as a countercurrent with respect to the air leak flowing as indicated by the arrow 21*f*, so as to inhibit the flow of the air leak into the semicircular clearance. Combined with the resistance offered to the flow of air by the narrow clearance, the countercurrent has the effect of suppressing the flow of air through the semicircular narrow clearance, so that the volume of air leak passing through the semicircular clearance into the impeller 10** can be reduced and the performance of the blower can be improved.

The provision of the curled portion **12*a* to the shroud 12 at its forward end increases its strength and its deformation during operation is minimized. Since the precision with which the parts are fabricated increases, it is possible to minimize the clearance between the curled portion 12*a* and the suction member 7**. Thus, the performance of the blower can be improved and its cost can be reduced because the impeller can be fabricated by means of a press; not by machining.

Figure 4:
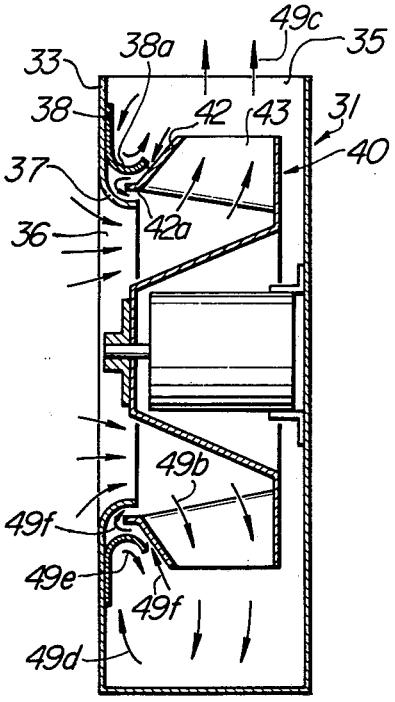
FIG. 4 is a vertical sectional view of the centrifugal blower comprising another embodiment.

FIG. 4 shows a second embodiment which is distinct from the first embodiment shown in FIGS. 1 and 2 in that a suction port 36 formed at one end plate 33 of a casing 31 is formed with a curved suction member 37, and an annular guide plate 38 of a semicircular shape in cross section is attached at one end portion to the inner surface of the end plate 33 and spaced apart at the other end portion from the inner surface of the suction member 37 by a suitable distance. The guide plate 38 is formed at its open end with a wall portion **38*a* located parallel to the inclined surface of a shroud 42 of a impeller 40, and an annular wall 42*a* is formed at the forward end of the shroud 42 on the suction side and extends into a space between the suction member 37 and guide plate 38. Other parts are similar to those shown in FIGS. 1 and 2**, so that their detailed description will be omitted.

In this embodiment, the majority of the air traversing vanes 43 and blown in a centrifugal direction **49*b* into the casing 31 is guided by the casing 31 and collected in a discharge portion 35 through which it is discharged from the blower in the direction of arrows 49*c*. However, part of the air flows toward the guide plate 38 as indicated by arrows 49***d*. A portion of the air stream passes through a clearance defined between the annular guide plate 38 and suction member 37 and the annular wall 42*a* at the forward end of the shroud 42 in the direction of an arrow 49*f* as air leak. The air leak is drawn again toward the suction side, but since the guide plate 38 has at its open end the wall portion 38*a* located along the shroud 42, a portion of the air leak passes in the direction of an arrow 49*e* along the outer side of the guide plate 38 and flows countercurrent to the stream of air leak tending to flow into the clearance in the direction of the arrow 42*f*. Thus, the stream of the air leak tending to flow into the clearance is suppressed by the countercurrent flowing in the direction of the arrow 49*e*; and the flow of the air leak is suppressed by not only the resistance offered to the flow of air by the narrow clearance but also the presence of the countercurrent, with the result that the volume of air leak is reduced and the performance of the blower is improved.

Figure 5:
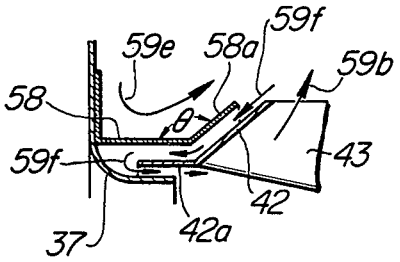
FIG. 5 is a fragmentary view, shown on an enlarged scale, of the suction member and shroud of still another embodiment.

FIG. 5 shows still another embodiment in which the guide plate is distinct in shape from the guide plate 38 shown in FIG. 4. Whereas the guide plate 38 shown in FIG. 4 is semicircular in cross section, the guide plate 58 shown in FIG. 5 is bent midway between its opposite ends at an obtuse angle $\theta$ in cross-section, and its wall portion 58*a* at its open end is located parallel to a shroud 42 and extends close to the outer periphery of vanes 43. Other parts are similar to those shown in FIG. 4, so that their detailed description will be omitted.

The embodiment shown in FIG. 5 has an additional advantage presently to be described, as compared with the embodiment shown in FIG. 4. Air leak passing into a clearance between the guide plate 58 and suction member 37 and the shroud 42 and its annular wall 42*a* at its forward end and flowing therethrough in the direction of arrows 59*f* is drawn by suction by an air current 59*b* flowing through the path of the vanes 43 and blown into the casing, so that the air leak tending to flow into the clearance is suppressed and has its volume further reduced, thereby improving the performance of the blower still more. In this FIG. 5, the numeral 59*e* shows a flow of air similar to the on indicated by the numeral 49*e* in FIG. 4.

Figure 6:
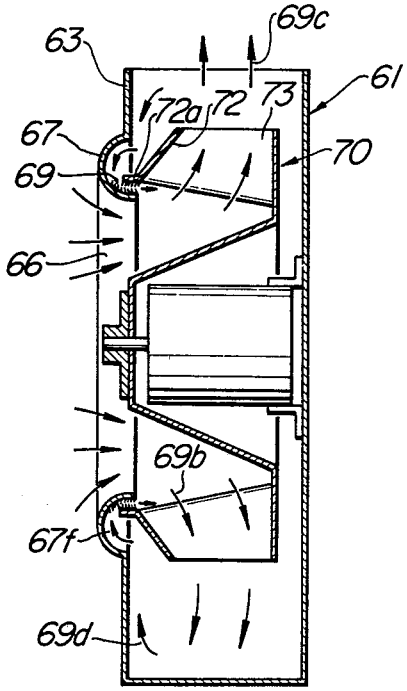
FIG. 6 is a vertical sectional view of the centrifugal blower comprising a further embodiment.

FIG. 6 shows a further embodiment in which a casing generally designated by the reference numeral 61 has a semicircular member 67 at a suction port 66 formed at an end plate 63 as is the case with the suction port 6 shown in FIG. 3 and a shroud 62 of impeller generally designated by the reference numeral 70 has an annular wall 72*a* at its forward end on the suction side like the shroud 42 shown in FIG. 4. A plurality of hair like elements 69 like elements are mounted on surfaces of the suction member 67 and the annular wall 72*a* disposed in spaced juxtaposed relation. Other parts are similar to those shown in FIGS. 1–5, so that their description will be omitted.

The majority of the air flowing through the path of vanes 73 and blown in a centrifugal direction 69*a* into a casing 61 is discharged out of the blower in the direction of arrows 69*c* through a discharge port, and part of the air flows in the direction of an arrow 69*d* toward the suction member 67 and passes into a clearance between the suction member 67 and the annular wall 72*a* at the forward end of the shroud 72 in the direction of an arrow 69*f*. Because of the presence of the hair like elements 69 on the wall surfaces defining the clearance, the resistance offered to the flow of the air is very high, so that the volume of air leak toward the suction side is reduced and the performance of the blower is improved. The hair like elements 69 have a length which may vary depending on the distance between the suction member 67 and the annular wall 72*a* of the shroud 72 and the nature of the hair like elements 69. Even if the provision of the hair like elements 69 reduces the size of the clearance between the suction member 67 and the annular wall 72*a* at the forward end of the shroud 72 and causes eccentricity to occur in the blower, the operation of the blower is not interferred with and no noise production results because the hair like elements 69 merely contact each other. When the hair-like elements 69 are slightly stiff, the volume of air leak can be further reduced and the performance of the blower can be improved still more by directing the length of the hair like elements 69 toward the direction of flow of the air leak.

FIG. 6 shows a preferred embodiment in hair-like elements 69 are mounted on wall surfaces of the suction member 67 and the annular wall 72*a* at the forward end of the shroud 72. However, the invention is not limited to this specific form of the embodiment and hair like elements 69 may be mounted on one side wall only. The same results can be achieved when hair like elements 69 are mounted on one wall surface and on two wall surfaces.

The suction member 67 is shown and described as being semicircular in cross section. However, the hair like elements 69 can be mounted so long as the wall facing the annular wall 72*a* at the forward end of the shroud 72 is of a semi-torous configuration.

What is claimed is:

1. A centrifugal blower comprising:

a casing including two end plates located in a spaced juxtaposed relation and enclosed at an outer periphery of the casing by a side plate formed with a discharge port, one of said two end plates being formed at a central portion thereof with a suction port having a suction member; and an impeller mounted in said casing including a shroud and plurality of backwardly curved vanes arranged circumferentially of the impeller; wherein the improvement comprises:

said suction member is shaped in semicircular form and the shroud of the impeller includes an inclined wall portion terminating with a curled wall means of semicircular form disposed in spaced juxtaposed relation to said suction member for creating a counter current so as to inhibit an air leak flow into a semicircular clearance defined between the semicircular suction member and curled wall means of the shroud.

2. A centrifugal blower comprising:

a casing including two end plates located in spaced juxtaposed relation and enclosed at an outer periphery by a side plate formed with a discharge port, one of said end plates being formed at a central portion thereof with a suction port having a suction member; and an impeller having a shroud mounted in said casing;

wherein said suction member has a semicircular shape and the shroud of the impeller includes an inclined wall portion terminating in a semicircular wall means disposed in spaced juxtaposition with at least a portion of the semicircular shaped suction member for creating a countercurrent so as to inhibit an air leak flow into a semicircular clearance between the semicircular suction member and the curled wall means of the shroud.

3. A centrifugal blower as claimed in one of claims 1 or 2, wherein said impeller includes a rotary plate formed at an intermediate portion with a conical portion defining a conical space for mounting an electric motor therein.

* * * * *